US009664148B2

(12) United States Patent
Foege

(10) Patent No.: US 9,664,148 B2
(45) Date of Patent: May 30, 2017

(54) ENGINE SYSTEM HAVING INCREASED PRESSURE EGR SYSTEM

(71) Applicant: Electro-Motive Diesel Inc., LaGrange, IL (US)

(72) Inventor: Aaron Gamache Foege, Westmont, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 154 days.

(21) Appl. No.: 14/675,644

(22) Filed: Mar. 31, 2015

(65) Prior Publication Data

US 2016/0290210 A1 Oct. 6, 2016

(51) Int. Cl.

| | |
|---|---|
| ***F02B 33/44*** | (2006.01) |
| ***F02M 25/06*** | (2016.01) |
| ***F02M 26/04*** | (2016.01) |
| ***F02M 26/43*** | (2016.01) |
| *F01N 13/10* | (2010.01) |

(52) U.S. Cl.

CPC ..... *F02M 26/04* (2016.02); *F02M 26/43* (2016.02); *F01N 13/107* (2013.01)

(58) Field of Classification Search

CPC ..... F02M 26/04; F02M 26/05; F02M 26/09; F02M 26/10; F02M 26/34; F01N 13/10

USPC ..... 60/605.2, 599; 701/108; 123/568.11–568.12

See application file for complete search history.

(56) References Cited

U.S. PATENT DOCUMENTS

| | | | | |
|---|---|---|---|---|
| 5,517,976 | A * | 5/1996 | Bachle | F02M 26/35 60/605.2 |
| 5,657,630 | A * | 8/1997 | Kjemtrup | F02M 26/34 60/605.2 |
| 5,791,146 | A * | 8/1998 | Dungner | F02M 26/34 60/605.2 |
| 6,237,335 | B1 * | 5/2001 | Lonnqvist | F02M 26/34 60/605.2 |
| 6,435,166 | B1 * | 8/2002 | Sato | F02M 26/34 60/605.2 |

(Continued)

FOREIGN PATENT DOCUMENTS

| | | |
|---|---|---|
| DE | 19717846 A1 | 11/1998 |
| WO | WO 2014/005127 A2 | 1/2014 |

*Primary Examiner* — Thai Ba Trieu

(74) *Attorney, Agent, or Firm* — Finnegan, Henderson, Farabow, Garrett & Dunner, LLP

(57) ABSTRACT

An engine system having donor cylinders and non-donor cylinders is disclosed. The engine system may have a first intake manifold configured to distribute air into the non-donor cylinders, and a second intake manifold separate from the first intake manifold and configured to distribute air into the donor cylinders. The engine system may also have a first exhaust manifold configured to discharge exhaust from the non-donor cylinders to the atmosphere, and a second exhaust manifold separate from the first exhaust manifold and configured to recirculate exhaust from the donor cylinders to the first intake manifold. The engine system may further have an orifice configured to regulate a flow rate of air flowing into the second intake manifold, a blower configured to regulate a flow rate of exhaust that is recirculated from the donor cylinders to the first intake manifold, and a controller configured to selectively control at least one of the orifice and the blower in response to a desired exhaust gas recirculation operating condition.

20 Claims, 1 Drawing Sheet

(56) References Cited

U.S. PATENT DOCUMENTS

| | | | | |
|---|---|---|---|---|
| 6,789,531 | B1 * | 9/2004 | Remmels | F02M 26/43 60/605.2 |
| 7,490,462 | B2 * | 2/2009 | Roozenboom | F02M 26/34 60/605.2 |
| 8,522,756 | B2 * | 9/2013 | Vuk | F02M 26/34 701/108 |
| 8,627,662 | B2 * | 1/2014 | Freund | F02M 26/05 60/605.2 |
| 8,857,156 | B2 | 10/2014 | Primus et al. | |
| 8,931,256 | B2 | 1/2015 | Moravec et al. | |
| 9,316,180 | B2 * | 4/2016 | Heiermann | F02M 26/05 60/605.2 |
| 2005/0000497 | A1 | 1/2005 | Nakai et al. | |
| 2006/0248888 | A1 | 11/2006 | Geskes | |
| 2007/0137615 | A1 | 6/2007 | Benz et al. | |
| 2011/0083641 | A1 * | 4/2011 | Gokhale | F02M 26/34 60/605.2 |
| 2011/0155111 | A1 | 6/2011 | Heilenbach et al. | |
| 2011/0307127 | A1 * | 12/2011 | Swenson | F02M 26/04 60/605.2 |
| 2012/0000448 | A1 * | 1/2012 | Freund | F02M 26/43 123/568.21 |
| 2012/0078492 | A1 * | 3/2012 | Freund | F02M 26/43 701/108 |
| 2012/0222659 | A1 | 9/2012 | Kulkarni et al. | |
| 2013/0081392 | A1 | 4/2013 | Klingbeil | |
| 2013/0104542 | A1 | 5/2013 | Klingbeil | |
| 2014/0069272 | A1 | 3/2014 | Cryer et al. | |
| 2014/0174078 | A1 | 6/2014 | Bandyopadhyay et al. | |
| 2014/0208717 | A1 * | 7/2014 | Moravec | F02M 26/43 60/274 |
| 2014/0208742 | A1 | 7/2014 | Bandyopadhyay et al. | |
| 2014/0209073 | A1 | 7/2014 | Johnson | |
| 2014/0260193 | A1 | 9/2014 | Moravec et al. | |
| 2014/0331978 | A1 | 11/2014 | Goetzke et al. | |
| 2014/0352672 | A1 | 12/2014 | Goetzke et al. | |

* cited by examiner

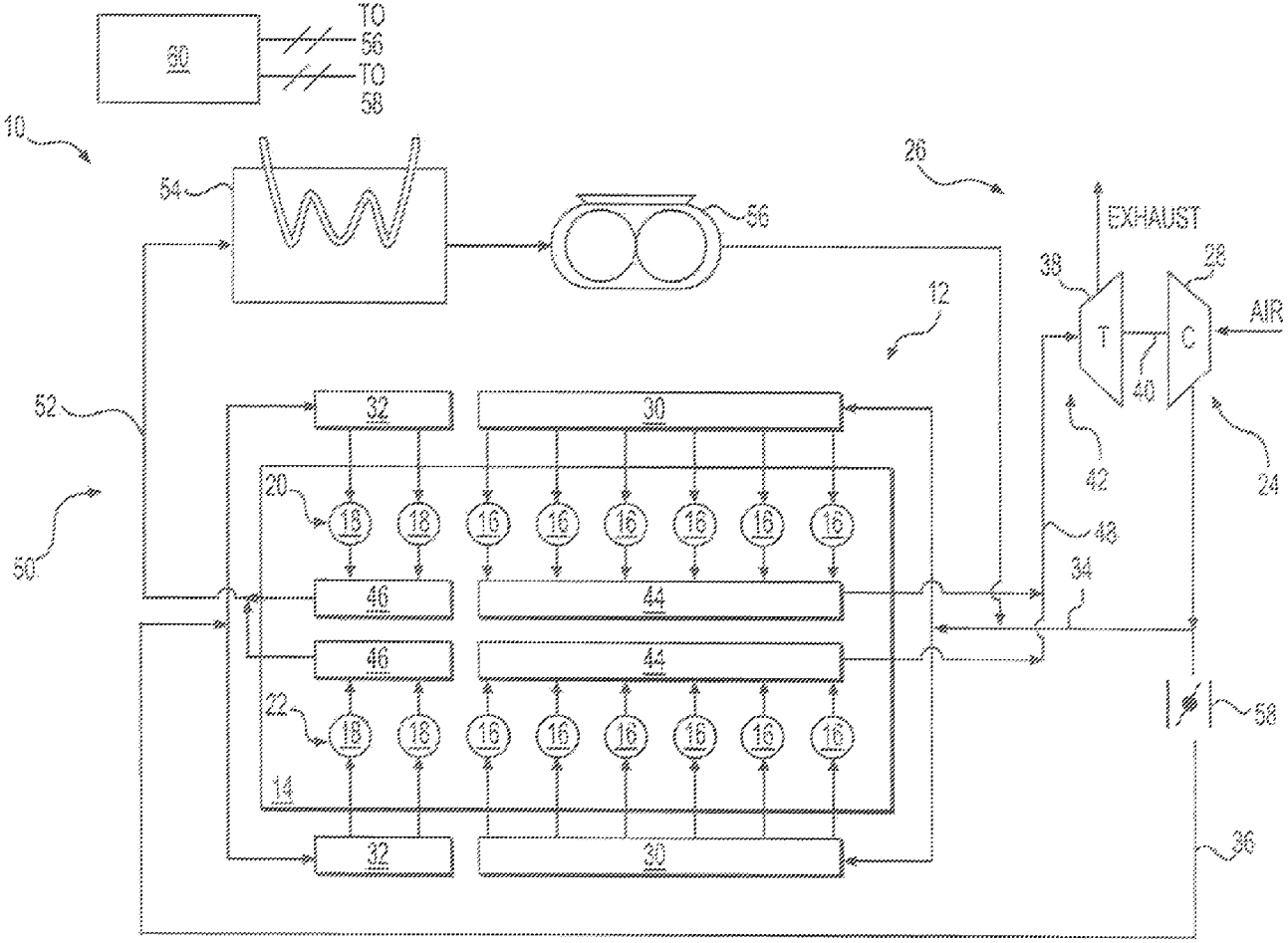
AIR
EXHAUST
C
T
24
26
28
38
40
42
48
34
58
36
12
26
56
30
44
44
30
16
16
16
16
16
16
16
16
16
16
32
46
46
32
18
18
18
18
20
22
14
54
60
TD
56
TD
58
10
52
50

ENGINE SYSTEM HAVING INCREASED PRESSURE EGR SYSTEM

TECHNICAL FIELD

The present disclosure relates generally to an engine system and, more particularly, to an engine system having an increased pressure within an exhaust gas recirculation (EGR) system.

BACKGROUND

Combustion engines such as diesel engines, gasoline engines, and gaseous fuel-powered engines are supplied with a mixture of air and fuel for combustion within the engine that generates a mechanical power output and a flow of exhaust gases. The exhaust gases can include a complex mixture of air pollutants produced as byproducts of the combustion process. For example, an engine can produce NOx, particulate matter, and hydrocarbons. Due to increased attention on the environment, the amount of pollutants emitted to the atmosphere from an engine can be regulated depending on the type of engine size of e and/or class of engine.

One method that has been implemented by engine manufacturers to comply with the regulation of exhaust emissions includes exhaust gas recirculation (EGR). EGR is the recirculation of a portion of the exhaust gas produced by the engine back to the intake of the engine to mix with fresh combustion air. The resulting mixture when ignited, produces a lower combustion temperature and a corresponding reduced amount of NOx.

An exemplary EGR system is disclosed in U.S. Patent Application Publication No. US 2012/0222659 A1 to Kulkarni et al. that published on Sep. 6, 2012 ("the '659 publication"). The '659 publication. discloses a four-stroke engine having a plurality of donor cylinders and a plurality of non-donor cylinders. Exhaust gases from the non-donor cylinders are directed to a first exhaust manifold, which routes the exhaust gases through a turbine and to the atmosphere. Exhaust gases from the donor cylinders are directed to a second exhaust manifold, which routes the exhaust gases through an exhaust gas recirculation (EGR) system and into an intake passage for both the donor and non-donor cylinders. The EGR system includes an EGR cooler to cool the exhaust gases before the exhaust gases return to the intake passage. The donor and non-donor cylinders are positioned in two banks of cylinders, with some donor cylinders arranged in between non-donor cylinders along each of the two banks of cylinders. In addition, two or more of the donor cylinders may be positioned immediately adjacent one another at a middle point along one of the two banks of cylinders, in order to reduce engine noise and vibration and to reduce a size of the second exhaust manifold, which routes exhaust gas from the donor cylinders to the intake passage of the engine.

Although the system of the '659 publication may help lower engine emissions by re-circulating the exhaust to the intake passage of the engine, the system may still be less than optimal. Specifically, the system of the '659 publication may be applicable to four-stroke engines. Two-stroke engines, which do not have discrete intake and exhaust strokes, may experience problems with pumping the exhaust from the donor cylinders back into the intake passage of the engine. Additionally arranging the donor cylinders at locations in between the non-donor cylinders along the bank of cylinders may increase the size of the exhaust manifold associated with the donor cylinders and cause problems with packaging other components associated with the EGR system within the engine system.

The engine system of the present disclosure solves one or more of the problems set forth above and/or other problems in the art.

SUMMARY

In one aspect, the present disclosure is directed to an engine system having donor and non-donor cylinders. The engine system may include a first intake manifold configured to distribute air into the non-donor cylinders, and a second intake manifold separate from the first intake manifold and configured to distribute air into the donor cylinders. The engine system may also include a first exhaust manifold configured to discharge exhaust from the non-donor cylinders to the atmosphere, and a second exhaust manifold separate from the first exhaust manifold and configured to recirculate exhaust from the donor cylinders to the first intake manifold. The engine system may further include an orifice configured to regulate a flow rate of air flowing into the second intake manifold, a blower configured to regulate a flow rate of exhaust that is recirculated from the donor cylinders to the first intake manifold, and a controller configured to selectively control at least one of the orifice and the blower in response to a desired exhaust gas recirculation operating condition.

In another aspect, the present disclosure is directed to a method of operating an engine haying donor cylinders and non-donor cylinders. The method may include distributing air through a first intake manifold into the non-donor cylinders, and distributing air through a second intake manifold into the donor cylinders. The second intake manifold may be separate from the first intake manifold. The method may also include discharging exhaust from the non-donor cylinders through a first exhaust manifold to the atmosphere, and recirculating exhaust from the donor cylinders through a second exhaust manifold to the first intake manifold. The second exhaust manifold may be separate from the first exhaust manifold. The method may further include selectively adjusting at least one of a flow rate of air flowing into the second intake manifold and a flow rate of recirculated exhaust flowing from the donor cylinders to the first intake manifold based on a desired exhaust gas recirculation operating condition.

In yet another aspect, the present disclosure is directed to an engine system having a two-stroke engine. The engine system may include a first cylinder bank including six non-donor cylinders and two donor cylinders, and a second cylinder bank including six non-donor cylinders and two donor cylinders. The engine system may also include a first intake manifold configured to distribute air into the non-donor cylinders of the engine and a second intake manifold separate from the first intake manifold and configured to distribute air into the donor cylinders of the engine. The engine system may further include a first exhaust manifold configured to discharge exhaust from the non-donor cylinders to the atmosphere, and a second exhaust manifold separate from the first exhaust manifold and configured to recirculate exhaust from the donor cylinders to the first intake manifold. The engine system may further include an orifice configured to regulate a flow rate of air flowing into the second intake manifold, a blower configured to regulate a flow rate of exhaust that is recirculated from the donor cylinders to the first intake manifold, and a controller configured to selectively control at least one of the orifice and the blower in response to a requested engine load.

BRIEF DESCRIPTION OF THE DRAWINGS

FIG. 1 is a schematic illustration of an exemplary disclosed engine system.

DETAILED DESCRIPTION

FIG. 1 illustrates an exemplary engine system 10. In the disclosed embodiment, engine system 10 includes a two-stroke diesel engine 12. It is contemplated that, in other embodiments, engine 12 may be another type of engine, for example, a four-stroke diesel engine, a two-stroke or four-stroke gasoline engine, or a two-stroke or four-stroke gaseous-fuel-powered engine. Engine 12 may include, among other things, an engine block 14 at least partially defining a plurality of cylinders 16, 18.

A piston (not shown) may be slidably disposed within each cylinder 16, 18 to reciprocate between a top-dead-center position and a bottom-dead-center position and a cylinder head (not shown) may be associated with each cylinder 16, 18. Each cylinder 16, 18, piston, and cylinder head may together at least partially define a combustion chamber. In the illustrated embodiment, engine 12 includes sixteen cylinders 16, 18 arranged in a V-configuration (i.e., a configuration having first and second banks 20, 22 or rows of cylinders 16, 18). However, it is contemplated that engine 12 may include a greater or lesser number of cylinders 16, 18 and that cylinders 16, 18 may be arranged in an inline configuration, in an opposing-piston configuration or in another configuration, if desired.

In the disclosed embodiment, cylinders 18 are donor cylinders, while cylinders 16 are non-donor cylinders. For the purposes of this disclosure, a donor cylinder is an engine cylinder, which donates some or all of the exhaust generated by that cylinder for recirculation through any of the cylinders in the engine. In contrast a non-donor cylinder is all engine cylinder from which all the exhaust is discharged to the atmosphere, and which does not donate any exhaust for recirculation through any of the cylinders in the engine. As illustrated in FIG. 1, four donor cylinders 18 are located immediately adjacent to each other at one end of engine 12 with two donor cylinders 18 being located on each bank 20, 22. The rest of the cylinders in banks 20, 22 may be non-donor cylinders 16. However, in other embodiments, it is contemplated that either bank 20, 22 may contain any number of donor cylinders 18. It is also contemplated that banks 20, 22 may each contain only non-donor cylinders, only donor cylinders, or a combination of both non-donor cylinders and donor cylinders.

As shown in FIG. 1, it may be preferable the select adjacent cylinders at one end of engine 12 as donor cylinders to help ensure compact packaging of components within engine system 10. Selecting non-adjacent cylinders a donor cylinders may require design of more complicated passages to collect the exhaust from the non-adjacent donor cylinders, which may lead to an increase in a size of engine 12. In addition, it may also be preferable to position donor cylinders at an end of engine 12 opposite any turbocharger device to further reduce an overall packaging size of engine system 10.

Engine system 10 may also include multiple separate sub-systems associated with engine 12 to cooperate and facilitate the production of power. For example, engine system 10 may include an air induction system 24 and an exhaust system 26. Air induction system 24 may be configured to direct air or an air and fuel mixture into engine 12 for subsequent combustion. Exhaust system 26 may exhaust byproducts of combustion to the atmosphere.

Air induction system 24 may include multiple components configured to condition and introduce compressed air into cylinders 16, 18. For example, air induction system 24 may include a compressor 28 configured to compress as and direct the compressed air to first and second intake manifolds 30, 32 via passages 34, 36, respectively. Intake manifolds 30 may direct the compressed air into non-donor cylinders 16, while intake manifolds 32 may direct the compressed air into donor cylinders 18. Intake manifolds 32 may be separate from intake manifolds 30. As used in this disclosure, separate means completely disconnected or isolated. Thus, there may be no passageway connecting intake manifolds 32 with intake manifolds 30. Although two separate intake manifolds 30 associated with banks 20, 22 are depicted in FIG. 1, one of ordinary skill in the art would recognize that the two intake manifolds 30 may be combined into a single intake manifold 30. Similarly, although two separate intake manifolds 32 associated with banks 20, 22 are depicted in FIG. 1, one of ordinary skill in the art would recognize that the two intake manifolds 32 may be combined into a single intake manifold 32. Compressor 28 may embody a fixed geometry compressor, a variable geometry compressor, or any other type of compressor configured to receive air and compress the air to a desired pressure level. It is contemplated that air induction system 24 may also include one or more coolers (not shown) located to cool air compressed by compressor 28 before it enters the combustion chambers of engine 12.

Exhaust system 26 may include, among other things, a turbine 38 driven by the exhaust from first exhaust manifolds 44 via passage 48 to rotate compressor 28 of air induction system 24. Exhaust manifolds 44 may receive exhaust generated by non-donor cylinders 16 in banks 20, 22. Exhaust from exhaust manifolds 44 may be directed to turbine 38 via passage 48 before being discharged into the atmosphere. Although two separate exhaust manifolds 44 associated with banks 20, 22 are depicted in FIG. 1, one of ordinary skill in the art would recognize that the two exhaust manifolds 44 may be combined into a single exhaust manifold 44. Turbine 38 may embody a fixed geometry turbine, a variable geometry turbine, or any other type of turbine configured to receive exhaust and convert potential energy in the exhaust to a mechanical rotation. Turbine 38 may be directly and mechanically connected to compressor 28 by way of a shaft 40 to form a turbocharger 42. As the hot exhaust gases exiting engine 12 move through turbine 38 and expand therein, turbine 38 may rotate and drive compressor 28 to pressurize inlet air. It is contemplated that exhaust system 26 may also include different or additional components than described above such as, for example, bypass components, an exhaust compression or restriction brake, an attenuation device, and other known components, if desired.

After passing through turbine 37, the exhaust may first be treated before being discharged to the atmosphere. In particular, one or more exhaust treatment devices (not shown) may be located to receive the exhaust from turbine 38. The exhaust treatment devices may include, for example, a particulate filter, one or more catalysts, or another treatment device known in the art. The exhaust treatment devices may be configured to remove, trap, reduce, or otherwise convert pollutants in the exhaust flow of engine 12 to innocuous substances.

Engine system 10 may also include an exhaust gas recirculation (EGR) system 50 configured to selectively divert exhaust from second exhaust manifolds 46 to air induction system 24. Exhaust manifolds 46 may be separate from exhaust manifolds 44. Thus, there may be no passage connecting exhaust manifolds 44 with exhaust manifolds 46. Exhaust manifolds 46 may receive exhaust generated by donor cylinders 18 in banks 20, 22. Exhaust from exhaust manifolds 46 may be redirected back into passage 34, where it is mixed with air from compressor 28 before entering non-donor cylinders 16. Although two separate exhaust manifolds 46 associated with banks 20, 22 are depicted in FIG. 1, one of ordinary skill in the art would recognize that the two exhaust manifolds 46 may be combined into a single exhaust manifold 46.

EGR system 50 may include an EGR passage 52 that is fluidly connected at a first end with one or more donor cylinders 18 in a manner separate from non-donor cylinders 16 and at a second end with air induction system 24. In the disclosed exemplary embodiment, EGR passage 52 is fluidly connected to exhaust manifolds 46 at the first end and connected to passage 34 at the second end. EGR system 50 may also include an EGR cooler 54, an EGR blower 56, an intake manifold biasing orifice 58, and a controller 60.

EGR cooler 54 may be located within EGR passage 52 and configured to cool exhaust passing therethrough. The cooled exhaust may mix with fresh air supplied by compressor 28 in passage 34 upstream of intake manifolds 30. Intake manifolds 30 may distribute the air-exhaust mixture to non-donor cylinders 16. EGR cooler 54 may be any type of heat exchanger known in the art that is configured to cool exhaust flowing through EGR passage 52. For example, EGR cooler 54 may be an air-to-liquid type of heat exchanger that receives coolant from and returns coolant to engine 12 (e.g., engine block 14). The coolant may be passed through spaced apart channels within EGR cooler 54 and used to absorb heat from exhaust passing through adjacent channels. It should be noted that EGR cooler 54 may alternatively be another type of heat exchanger, if desired, such as an air-to-air heat exchanger.

EGR blower 56 may be located within EGR passage 52 and configured to regulate a flow of fluid passing therethrough (i.e., increase a mass flow rate of the cooled exhaust from EGR cooler 54) and direct the cooled exhaust at an increased pressure level to mix with fresh air supplied by compressor 28 in passage 34 upstream of intake manifolds 30. EGR blower 56 may embody, for example, an electric blower, a hydraulic blower, or any blower known in the art. EGR blower 56 may be used to maintain an elevated pressure within EGR system 50 (i.e., a pressure elevated above the pressure of intake manifold 30), thereby allowing exhaust to be draw from exhaust manifolds 46 and back into intake manifolds 30. In some embodiments, EGR blower 56 may be controlled based on a desired EGR operating condition via controller 60, as will be described in more detail below.

Orifice 58 may be located within passage 36 and configured to bias a flow of fluid (e.g., a mass flow rate of air) passing from compressor 28 to either non-donor cylinders 16 or donor cylinders 18. Orifice 58 may embody, for example, a variable orifice that is solenoid-driven, which can be continuously-adjusted between a fully-closed position and a fully-open position. Alternatively, orifice 58 may be capable of only being fully-closed or fully-opened. In some embodiments, orifice 58 may also be controlled based on a desired EGR operating condition via controller 60, as will be described in more detail below.

Controller 60 may be configured to control the operation of engine system 10 and/or EGR system 50. For example, controller 60 may receive data indicative of an operational condition of engine 12 and/or an actual flow rate, temperature pressure, and/or constituency of exhaust within exhaust manifolds 44, 46 and/or EGR system 50. Such data may be received from another controller or computer (not shown), from sensors strategically located throughout engine system 10, and/or from a user of engine 12. Controller 60 may then utilize stored algorithms, equations, subroutines, look-up maps and/or tables to analyze the operational condition data and determine corresponding desired EGR operating condition (e.g., a flow rate and/or constituency of exhaust within passage 48 that sufficiently reduces the amount of pollutants discharged to the atmosphere). Based on the desired flow rate and/or constituency, controller 60 may then selectively control EGR blower 56 and/or orifice 58, such that the desired amounts of exhaust may be supplied by EGR system 50 into intake manifolds 30.

Controller 60 may embody a single microprocessor, multiple microprocessors, digital signal processors (DSPs) etc. that include means for controlling an operation of engine system 10 and/or EGR system 50. Numerous commercially available microprocessors can be configured to perform the functions of controller 60. It should be appreciated that controller 60 could readily embody a microprocessor separate from that controlling other machine-related functions, or that controller 60 could be integral with a machine microprocessor and be capable of controlling numerous machine functions and modes of operation. If separate from the general machine microprocessor, controller 60 may communicate with the general machine microprocessor via data links or other methods. Various other known circuits may be associated with controller 60, including power supply circuitry , signal-conditioning circuitry, actuator driver circuitry (i.e., circuitry powering solenoids, motors, or piezo actuators), and communication circuitry.

In some embodiments, controller 60 may selectively control EGR blower 56 and/or orifice 58 in response to a desired EGR operating condition. For example, in certain situations, the desired EGR operating condition may depend on a requested load on engine 12. Specifically, controller 60 may determine that a load change is required and thus, a change in EGR operation is required. For instance, when a higher load is required, controller 60 may determine that more exhaust should be recirculated back into intake manifolds 30. Subsequently, controller 60 may increase a speed of EGR blower 56 in order to increase an amount of exhaust forced into intake manifolds 30. Alternatively or additionally, controller 60 may increase an opening of orifice 58 to increase the mass flow rate of air that is forced into intake manifolds 32, thereby creating more exhaust from donor cylinders 18 to be recirculated back into intake manifolds 30. With more exhaust being recirculated into intake manifolds 30, this may increase power output of 12, thereby achieving the higher load requirements. Similarly, when a lower load is required, controller 60 may determine that less exhaust needs to be recirculated. In response, controller 60 may decrease a speed of EGR blower 56 in order to decrease an amount of exhaust forced into intake manifolds 30. Alternatively or additionally, controller 60 may decrease an opening of orifice 58 to decrease the mass flow rate of air that is forced into intake manifolds 32. By decreasing the exhaust being recirculated back into intake manifolds 30 during low-load conditions, this may reduce the overall power output of engine 12 and save energy used by its components, such as EGR blower 56. Together, EGR blower 56, orifice 58, and controller 60 may help ensure the desired EGR operating condition is achieved at various loading states.

Controller 60 may also function to control one or more operating parameters associated with each cylinder 16, 18 to help to achieve the desired EGR operating condition. In the disclosed embodiment, because intake manifolds 30 are separate from intake manifolds 32, and exhaust manifolds 44 are separate from exhaust manifolds 46, donor cylinders 18 are isolated from non-donor cylinders 16. This configuration may allow non-donor cylinders 16 and donor cylinders 18 to have substantially different cylinder pressures, air-to-fuel ratios, and/or fuel injection timings. For example, controller 60 may cause donor cylinders 18 to have higher cylinder pressures, higher air-to-fuel ratios, and more frequent fuel injections than non-donor cylinders 16 to create a more potent exhaust gas. The more potent exhaust gas may provide a smaller volumetric flow rate of exhaust with the same engine benefits. This may allow EGR system 50 to utilize smaller EGR components, such as a smaller EGR blower 56 and a smaller EGR cooler 54. The reduced size of these components may help to reduce an overall size of engine system 10.

INDUSTRIAL APPLICABILITY

The disclosed engine system may be used in any machine or power system application where it is beneficial to reduce an amount of pollutants discharged into the atmosphere. The disclosed engine system may find particular applicability with mobile machines such as locomotives, which can be subjected to large variations in load. The disclosed engine system may find particular applicability with two-stroke engines, which do not have discrete intake, and exhaust strokes. Specifically, the disclosed EGR blower and intake manifold biasing orifice may help to pump exhaust from the donor cylinders o the intake passage to the non-donor cylinders, allowing EGR to be achieved without discrete intake and exhaust strokes. The disclosed engine system may provide an improved method for reducing the amount of pollutants in the exhaust discharged to the atmosphere. An exemplary operation of engine system 10 will now be described.

During operation of engine system 10 air or a mixture of air and fuel may be pressurized by compressor 28 and directed into cylinders 16, 18 for subsequent combustion. Combustion of the air/fuel mixture may result in mechanical power being generated and directed from engine system 10 by way of a rotating crankshaft. By-products of combustion, namely exhaust and heat, may flow from non-donor cylinders 16 through turbine 38 to the atmosphere.

Exhaust and heat produced in donor cylinders 18 of engine system 10 may be recirculated by exhaust manifolds 46 into intake manifolds 30. EGR cooler 54 may receive exhaust from exhaust manifolds 46 and may cool the exhaust before it mixes with compressed air from compressor 28 in intake manifold 30, which may distribute the exhaust-air mixture to non-donor cylinders 16. The recirculation of exhaust may help dilute the mixture of fuel and air and increase the thermal capacity within non-donor cylinders 16, resulting in a lower combustion temperature. The lower combustion temperature in non-donor cylinders 16 may help reduce an amount of pollutants produced during combustion.

During an exemplary operation of engine system 10, controller 60 may selectively control EGR blower 56 and/or orifice 58 to help deliver a desired amount of exhaust from exhaust manifolds 46 to intake manifolds 30. For example, controller 60 may in a speed of EGR blower 56 and/or increase an opening of orifice 58 to increase the amount of exhaust recirculated from exhaust manifolds 46 to intake manifolds 30 in response to a higher engine load request. Alternatively, controller 60 may decrease a speed of EGR blower 56 and/or decrease an opening of orifice 58 to decrease the amount of exhaust recirculated from exhaust manifolds 46 to intake manifolds 30 in response to a lower engine load request.

In one application of the exemplary operation of engine system 10, the air/fuel mixture from compressor 28 supplied to passages 34, 36 may contain about 20-22% oxygen gas, while the exhaust recirculated by exhaust manifolds 46 may contain about 15-19% oxygen gas. And when the exhaust mixes with the air/fuel mixture during the EGR operation, the mixture within intake manifolds 30 may contain about 15-20% oxygen (e.g., about 18% oxygen), which may be the desired level of oxygen gas for reducing the amount of pollutants in the exhaust discharged to the atmosphere.

The use of EGR blower 56 and intake manifold biasing orifice 58 may provide an increased pressure within EGR system 50. Specifically, EGR blower 56 may help to provide an elevated pressure in EGR passage 52, allowing the exhaust to be pumped from donor cylinders 18 to non-donor cylinders 16. In addition orifice 58 may be used to increase the flow rate of air provided to donor cylinders 18 to increase the flow rate of exhaust being recirculated from donor cylinders 18 to non-donor cylinders 16. As a result, the disclosed engine system may respond quickly to transient loads or variations in required power output because of the increased pressure within EGR system 50.

It will be apparent to those skilled in the art that various modifications and variations can be made to the disclosed engine system without departing from the scope of the disclosure. Other embodiments of the engine system will be apparent to those skilled in the art from consideration of the specification and practice of the engine system disclosed herein. It is intended that the specification and examples be considered as exemplary only, with a true scope of disclosure being indicated by the following claims and their equivalents.

What is claimed is:

1. An engine system having donor cylinders and non-donor cylinders, comprising:
- a first intake manifold configured to distribute air into the non-donor cylinders;
- a second intake manifold separate from the first intake manifold and configured to distribute of into the donor cylinders;
- a first exhaust manifold configured to discharge exhaust from the non-donor cylinders to the atmosphere;
- a second exhaust manifold separate from the first exhaust manifold and configured to recirculate exhaust from the donor cylinders to the first intake manifold;
- an adjustably variable orifice configured to regulate a flow rate of air flowing into the second intake manifold;
- a blower configured to regulate a flow rate of exhaust that is recirculated from the donor cylinders to the first intake manifold, wherein the blower is positioned upstream of the first intake manifold; and
- a controller configured to selectively control an operation of at least one of the adjustably variable orifice and the blower in response to a desired exhaust gas recirculation operating condition corresponding to a load change on the engine system.

2. The engine system of claim wherein the desired exhaust gas recirculation operating condition is based on a requested engine load.

3. The engine system of claim 2, wherein, when an engine load is higher than the requested engine load, the controller is configured to increase an amount of exhaust that is recirculated from the donor cylinders to the first intake manifold by increasing at least one of:

a speed of the blower; and an opening of the adjustably variable orifice.

4. The engine system of claim 2, wherein, when an engine load is lower than the requested engine load, the controller is configured to decrease an amount of exhaust that is recirculated from the donor cylinders to the first intake manifold by decreasing at least one of:

a speed of the blower; and an opening of the adjustably variable orifice.

5. The engine system of claim 1, further including a cooler configured to cool exhaust that is recirculated from the donor cylinders to the first intake manifold.

6. The engine system of claim 1, further including:

a compressor configured to compress air and direct the compressed air to the first and second intake manifolds; and a turbine connected to drive the compressor and configured to receive exhaust from the first exhaust manifold.

7. The engine system of claim 6, wherein the exhaust recirculated from the donor cylinders to the first intake manifold is recirculated to a location downstream of the compressor.

8. The engine system of claim 6, further including:

a first passage extending from the compressor to the first intake manifold; and a second passage extending from the compressor to the second intake manifold, wherein the adjustably variable orifice is disposed in the second passage.

9. The engine system of claim 1, wherein the donor cylinders include four donor cylinders and the non-donor cylinders include twelve non-donor cylinders, and wherein the donor cylinders are located immediately adjacent to one another at one end of the engine with two donor cylinders being located on each of first and second banks of cylinders.

10. The engine system of claim 1, wherein exhaust recirculated from the donor cylinders is recirculated to the non-donor cylinders, but not to the donor cylinders; and further comprising a first cylinder bank including six non-donor cylinders and two donor cylinders, and a second cylinder bank including six non-donor cylinders and two donor cylinders.

11. A method of operating an engine having donor cylinders and non-donor cylinders, comprising:

distributing air through a first intake manifold into the non-donor cylinders;

distributing air through a second intake manifold into the donor cylinders, the second intake manifold being separate from the first intake manifold;

discharging exhaust from the non-donor cylinders through a first exhaust manifold to the atmosphere;

recirculating exhaust from the donor cylinders through a second exhaust manifold to the first intake manifold, the second exhaust manifold being separate from the first exhaust manifold; and by a controller, selectively adjusting at least one of a flow rate of air flowing into the second intake manifold and a flow rate of recirculated exhaust flowing from the donor cylinders to the first intake manifold based on a desired exhaust gas recirculation operating condition corresponding to a load change on the engine to control a blower and an adjustably variable orifice.

12. The method of claim 11, further including selectively adjusting at least one of a the flow rate of the air flowing into the second intake manifold and a the flow rate of the recirculated exhaust flowing from the donor cylinders to the first intake manifold based on a requested engine load.

13. The method of claim 12, further including, when an engine load is higher than the requested engine load, increasing an amount of exhaust that is recirculated from the donor cylinders to the first intake manifold by increasing at least one of:

the flow rate of the recirculated exhaust flowing from the donor cylinders to the first intake manifold; and flow rate of the air flowing into the second intake manifold.

14. The method of claim 12, further including, when an engine load is lower than the requested engine load, decreasing an amount of exhaust that is recirculated from the donor cylinders to the first intake manifold by decreasing at least one of:

the flow rate of the recirculated exhaust flowing from the donor cylinders to the first intake manifold; and the flow rate of the air flowing into the second intake manifold.

15. The method of claim 11, further including cooling exhaust that is recirculated from the donor cylinders to the first intake manifold using a heat exchanger.

16. The method of claim 11, further including compressing air, using at least a compressor, to yield compressed of and directing the compressed air to the first and second intake manifolds.

17. The method of claim 16, wherein the recirculated exhaust is recirculated to the non-donor cylinders, but not to the donor cylinders.

18. The method of claim 16, wherein the recirculated exhaust is mixed with the compressed air before entering the first intake manifold; and wherein the engine includes six non-donor cylinders and two donor cylinders in a first cylinder bank and six non-donor cylinders and two donor cylinders in a second cylinder bank.

19. The method of claim 18, wherein the mixture of the recirculated exhaust and the compressed air contains about 15-20% oxygen.

20. An engine system having a two-stroke engine, comprising:

a first cylinder bank including six non-donor cylinders and two donor cylinders;

a second cylinder bank including six non-donor cylinders and two donor cylinders;

a first intake manifold configured to distribute air into the non-donor cylinders of the engine;

a second intake manifold separate from the first intake manifold and configured to distribute air into the donor cylinders of the engine;

a first exhaust manifold configured to discharge exhaust from the non-donor cylinders to the atmosphere;

a second exhaust manifold separate from the first exhaust manifold and configured to recirculate exhaust from the donor cylinders to the first intake manifold;

an adjustably variable orifice configured to regulate a flow rate of aft flowing into the second intake manifold;

a blower configured to regulate a flow rate of exhaust that is recirculated from the donor cylinders to the first intake manifold; and a controller configured to selectively control at least one of the adjustably variable orifice and the blower in response to a requested engine load.

* * * * *